US011523687B2

(12) United States Patent
Koetter, Jr. et al.

(10) Patent No.: US 11,523,687 B2
(45) Date of Patent: Dec. 13, 2022

(54) PORTABLE BARREL RACK

(71) Applicant: Koetter-Rax, LLC, Floyds Knobs, IN (US)

(72) Inventors: Robert J. Koetter, Jr., Floyds Knobs, IN (US); Gerald T. Koetter, Floyds Knobs, IN (US); Raymond Todd Magner, New Salisbury, IN (US); Brian S. Keith, Charlestown, IN (US); Greg Schmidt, Louisville, KY (US); Anthony Ferrera, Crestwood, KY (US); Mark Duane Cooke, Salem, IN (US); Clark Gregory, Charlestown, IN (US); Darr Scott Thompson, Sellersburg, IN (US); John F. Koerber, Floyds Knobs, IN (US); Adam Ray, Lexington, KY (US)

(73) Assignee: Koetter-Rax, LLC, Floyds Knobs, IN (US)

( * ) Notice: Subject to any disclaimer, the term of this patent is extended or adjusted under 35 U.S.C. 154(b) by 0 days.

(21) Appl. No.: 17/408,659

(22) Filed: Aug. 23, 2021

(65) Prior Publication Data

US 2022/0053932 A1 Feb. 24, 2022

Related U.S. Application Data

(60) Provisional application No. 63/069,499, filed on Aug. 24, 2020.

(51) Int. Cl.

| | |
|---|---|
| ***A47B 81/00*** | (2006.01) |
| ***A47B 87/00*** | (2006.01) |
| ***A47B 87/02*** | (2006.01) |

(52) U.S. Cl.
CPC ..... *A47B 81/007* (2013.01); *A47B 87/005* (2013.01); *A47B 87/0207* (2013.01)

(58) Field of Classification Search
CPC ... A47B 81/007; A47B 87/005; A47B 81/005; A47B 87/0207; A47B 87/02; A47B 87/215; A47B 47/045; A47B 47/028; A47B 47/027; A47B 47/021; A47B 47/0083
See application file for complete search history.

(56) References Cited

U.S. PATENT DOCUMENTS

| | | | |
|---|---|---|---|
| 1,075,801 | A | 10/1913 | Waters |
| 2,072,699 | A | 3/1937 | Ansel |

(Continued)

FOREIGN PATENT DOCUMENTS

| | | |
|---|---|---|
| RU | 2270749 | 2/2006 |

OTHER PUBLICATIONS

ISR/WO pertaining to PCT/US2021/047060 filing date Aug. 23, 2021, to Koetter-Rax, LLC mailed Nov. 25, 2021.

*Primary Examiner* — Devin K Barnett
(74) *Attorney, Agent, or Firm* — Dentons Bingham Greenebaum LLP; Brian W. Chellgren; James C. Eaves, Jr.

(57) ABSTRACT

The present invention relates to a portable barrel rack. The portable barrel rack allows for storage and transportation of multiple barrels with the weight of each barrel being supported by the rack. Racks have lower and upper rectangular frames of different construction, with posts therebetween, and with legs and matching contours so that racks can be stacked. Slats inserted into grooves can retain barrels contained within the racks.

16 Claims, 10 Drawing Sheets

(56) References Cited

U.S. PATENT DOCUMENTS

| | | | | | |
|---|---|---|---|---|---|
| 2,995,257 | A * | 8/1961 | Blaise | A47B 31/00 | 211/208 |
| 3,199,683 | A * | 8/1965 | Graswich | A47B 57/425 | 211/208 |
| 5,228,821 | A * | 7/1993 | Gleffe | B65D 19/12 | 211/195 |
| D374,594 | S * | 10/1996 | Munoz | D7/708 | |
| 6,402,167 | B1 * | 6/2002 | Calleja | B65D 19/44 | 280/47.35 |
| 6,679,507 | B1 * | 1/2004 | Ahm | A01C 1/042 | 220/6 |
| D715,013 | S * | 10/2014 | Allen | D34/27 | |
| 8,950,832 | B2 * | 2/2015 | Schag | A47B 96/20 | 312/265.1 |
| 9,445,670 | B1 * | 9/2016 | Stiefel | H05K 5/0017 | |
| 9,974,203 | B1 * | 5/2018 | Ho | H05K 7/1489 | |
| 10,960,910 | B1 * | 3/2021 | Garcia | B62B 3/02 | |
| 2010/0181271 | A1 * | 7/2010 | Vergara | A23B 4/062 | 211/85.4 |
| 2015/0225172 | A1 * | 8/2015 | Barber | A47B 81/007 | 211/23 |
| 2017/0303678 | A1 * | 10/2017 | Palazeti | A47B 33/00 | |
| 2018/0125231 | A1 * | 5/2018 | Reyes | A47B 47/0091 | |
| 2021/0315379 | A1 * | 10/2021 | Koetter, Jr | A47B 47/047 | |
| 2021/0315380 | A1 * | 10/2021 | Ferrera | A47B 81/007 | |

* cited by examiner

PORTABLE BARREL RACK

FIELD

The present invention relates to a portable barrel rack. The portable barrel rack allows for storage and transportation of multiple barrels with the weight of each barrel being supported by the rack.

BACKGROUND

For hundreds of years, alcoholic beverages have been aged and stored in barrels. In the bourbon industry, barrels are typically filled with bourbon at a distillery, rolled on their sides into a truck, and driven to a racked warehouse, known as a rickhouse or rackhouse, or a palletized warehouse for storage and aging. In a rickhouse, barrels are moved by being rolled on their sides, then lifted via a barrel ricker and loaded into a multi-level storage rack. After months or, more typically, years of aging in a horizontal orientation, the barrels are removed from the rack and rolled into trucks for transportation to a bottling facility. This traditional storage method is labor intensive, as barrels are individually loaded into and removed from the storage rack, and a typical rickhouse accommodates tens of thousands of barrels. In addition, rickhouses are specialized buildings that cannot easily be used for purposes other than barrel storage, which leads to inefficiencies if the entire storage capacity of the rickhouse is not needed.

In a palletized warehouse, barrels are rolled out of the truck, rotated onto their ends, and up to nine barrels are loaded onto a pallet in an upright orientation. Such pallets of barrels are often stacked atop each other in pillars up to seven pallets high for storage and aging. After aging the barrels in an upright orientation, pallets are unstacked, the barrels are rotated onto their sides, then rolled into trucks for transportation to a bottling facility. Storing barrels on pallets is convenient for transportation, as individual pallets may be readily moved via forklift. Palletization also saves space, as barrels are more tightly spaced together than in a rickhouse. Palletized warehouses are also more flexible than rickhouses, as excess space may be used for purposes other than barrel storage. However, tightly packing barrels in pillars of pallets restricts airflow, which can affect the aging process. In addition, storing barrels in pillars of pallets subjects the bottom barrels to significant loads as they support the weight of other barrels and pallets. Applying such loads to barrels increases the risk of leakage or even failure, which creates a safety hazard.

Barrels may also be stored on their sides using small, individual racks shaped to fit the curvature of the barrel sides. These individual racks are typically symmetrical on their tops and bottoms, so a rack may be placed beneath a first barrel to support that barrel, and another rack placed atop the first barrel to support a second barrel atop that first barrel. Such individual racks are convenient for quick assembly and disassembly of storage systems but, similar to palletized storage, subject bottom barrels to significant loads by supporting the weight of barrels stacked above them.

Individual barrels tend to age at different rates in a warehouse. Warm air rises, such that barrels stored at higher elevations in a palletized warehouse or rickhouse experience different environmental conditions than barrels stored at lower elevations. Barrels may be moved within a palletized warehouse or rickhouse to provide a more uniform aging experience, shifting barrels stored at higher elevations to lower elevations and vice versa. However, in a rickhouse, multiple workers must laboriously unload an individual barrel from a storage rack, roll it to an elevator or escalator, raise or lower it to a different level in the rack, and load the barrel back into the rack at a new location. Rearranging barrels within a rickhouse or palletized warehouse is rarely, if ever, performed due to the labor involved. Instead, the contents of barrels aged at different elevations are typically blended together to provide a more uniform product.

The inventors of the present disclosure realized that improvements are needed in barrel storage and transportation. Certain preferred features of the present disclosure address these and other needs and provide other important advantages.

SUMMARY

The disclosed portable barrel rack combines the advantages of palletized and rickhouse storage systems. The portable barrel rack includes an upper rectangular frame supported above a lower rectangular frame by a plurality of posts. Rows of barrels are supported on dunnage between the posts. Advantages of the portable barrel rack include, but are not limited to, providing a safe and secure means to transport and store barrels arranged on their sides where the weight of the barrels is supported by the rack, not other barrels. The disclosed portable barrel rack is sized and configured to be transportable by forklift and to fit inside a standard container-type semi-trailer or shipping container. Barrels may be filled, emptied, transported to and from a warehouse, and stored and moved within a warehouse, without being removed from the rack. Portable barrel racks may be securely stacked atop each other, each rack mechanically engaging the rack positioned above it. These stacks may be readily assembled and disassembled, making it practical to rearrange barrels to different elevations within a warehouse to provide a more uniform aging experience.

The portable barrel racks are designed with a lower rectangular frame such that the lower side beams run the length of the rack and have lower end beams between the lower side beams. Also, posts extend upward from the lower side beams, not the lower end beams, so that when a forklift lifts the rack by having its forks pass under the lower side beams, all of the weight of the rack and any barrels contained therein is supported by the lower side beams. At the top of the rack, upper side beams and upper end beams are received between the tops of the posts, providing additional support for the weight of any barrels contained in the rack. Also, the use of downward sloping slots in posts designed to receive an adjustable slat therein permits barrels contained within the rack to be securely retained. Also, contours with recesses therein at the top of the rack are sized so that the legs of another rack can be received therein so that racks can be stacked atop each other. For example, 2 stacked racks may be transported or more racks can be stacked for aging in a rickhouse.

More specifically, a portable barrel rack designed for example to hold 6 barrels in 1 column with 2 rows of 3 barrels each includes a lower rectangular frame having at least two lower side beams, each lower side beam having a top side, a bottom side, at least one interior side, a first end portion and an opposed second end portion, the lower rectangular frame further having at least two lower end beams, each lower end beam having a top side, a bottom side, a first end and an opposed second end; where the first end of a first lower end beam is attached to the first end portion of a first lower side beam on an interior side of the first lower side beam and the opposed second end of the first lower end beam is attached to the first end portion of a second lower side beam on an interior side of the second lower side beam, where the first end of a second lower end beam is attached to the opposed second end portion of the first lower side beam on the interior side of the first lower side beam and the opposed second end of the second lower end beam is attached to the opposed second end portion of the second lower side beam on the interior side of the second lower side beam, the lower side beams being in a parallel relationship and transverse to the lower end beams thereby forming the lower rectangular frame; a plurality of posts, each of the lower side beams having a first post attached thereto and extending upward from its top side at its first end portion and a second post attached thereto and extending upward from its top side at its opposed second end portion, the posts being in a parallel relationship and having the same length, each post having a post top end and a plurality of beam mounting areas along the sides of each post and adjacent to the post top end, each post having at least one interior side; an upper rectangular frame having at least two upper side beams, each upper side beam having a first end and an opposed second end, the upper rectangular frame further having at least two upper end beams, each upper end beam having a first end and an opposed second end; where the first end of a first upper side beam is attached to a first beam mounting area of the first post attached to the first lower side beam and the opposed second end of the first upper side beam is attached to a first beam mounting area of the second post attached to the first lower side beam; where the first end of a second upper side beam is attached to a first beam mounting area of the first post attached to the second lower side beam and the opposed second end of the upper side beam is attached to a first beam mounting area of the second post attached to the second lower side beam; where the first end of a first upper end beam is attached to a second beam mounting area of the first post attached to the first lower side beam and the opposed second end of the first upper end beam is attached to a second beam mounting area of the first post attached to the second lower side beam; and where the first end of a second upper end beam is attached to a second beam mounting area of the second post attached to the first lower side beam and the opposed second end of the second upper end beam is attached to a second beam mounting area of the second post attached to the second lower side beam thereby forming the upper rectangular frame; a plurality of dunnage rails, where a first dunnage rail is attached on an interior side of the first and second posts attached to the first lower side beam and where a second dunnage rail is attached on an interior side of the first and second posts attached to the second lower side beam, where the first and second dunnage rails are in a parallel relationship to each other and to the lower side beams and at a same first height thereabove, the first and second dunnage rails facing each other, and; where legs extend downward from the bottom sides of the two lower end beams and from the bottom sides of the two lower side beams underneath their portions where the posts are attached.

In the portable barrel rack, the first posts can each have a downward sloping groove therein located on the first posts at a location equally above the first height, the grooves having a removable slat therein, the slat extending between the first posts.

Further, the portable barrel rack can include a third dunnage rail attached on an interior side of the first and second posts attached to the first lower side beam and a fourth dunnage rail attached on an interior side of the first and second posts attached to the second lower side beam, where the third and fourth dunnage rails are in a parallel relationship to each other and to the lower side beams and at a same second height thereabove, the second height being greater than the first height, the third and fourth dunnage rails facing each other. In this configuration, the first posts each have a first downward sloping groove therein located on the first posts at a location equally above the first height and below the second height; and where the first posts each have a second downward sloping groove therein located on the first posts at a location above the second height, the first and second grooves each having a removable slat therein, the slats extending between the first posts.

Even further, the portable barrel rack can include a first contoured piece across the top of the first posts and the first upper end beam and a second contoured piece across the top of the second posts and the second upper end beam, the contoured pieces each having a recess therein sized to receive a portion of the legs of a second portable barrel rack stacked atop the portable barrel rack. Also, the interior sides of the first and second posts where the first, second, third, and fourth dunnage rails are to be attached each have a recessed portion so that the corresponding dunnage rail is recessed therein.

In addition, an X-brace can be secured between at least one of the area between the lower side beams and the lower end beams; the open area between the second lower side beam and its upward extending first and second posts and the second upper side beam; the open area between the first lower side beam and its upward extending first and second posts and the first upper side beam; or the open area between second lower end beam and the second upper end beam and the second posts therebetween. Further, the attachments of the side beams, end beams, and posts is accomplished by tongue and groove attachments. This can be by using traditional tongue and groove joints or a sliding dovetail joint which is a tongue and groove type joint. Also, each of the legs can be a single piece, a first leg extending below and parallel to the first lower end beam and a second leg extending below and parallel to the second lower end beam.

In addition to the rack described above and designed for example to hold 6 barrels in 1 column with 2 rows of 3 barrels each, a portable barrel rack designed for example to hold 12 barrels in 2 columns each column with 2 rows of 3 barrels each includes: a lower rectangular frame having at least three lower side beams, each lower side beam having a top side, a bottom side, at least one interior side, a first end portion and an opposed second end portion, the lower rectangular frame further having at least four lower end beams, each lower end beam having a top side, a bottom side, a first end and an opposed second end; where the first end of a first lower end beam is attached to the first end portion of a first lower side beam on an interior side of the first lower side beam and the opposed second end of the first lower end beam is attached to the first end portion of a second lower side beam on a first interior side of the second lower side beam, where the first end of a second lower end beam is attached to the opposed second end portion of the first lower side beam on the interior side of the first lower side beam and the opposed second end of the second lower end beam is attached to the opposed second end portion of the second lower side beam on the first interior side of the second lower side beam, where the first end of a third lower end beam is attached to the first end portion of the second lower side beam on a second interior side of the second lower side beam and the opposed second end of the third lower end beam is attached to the first end portion of a third lower side beam on a first interior side of the third lower side beam, where the first end of a fourth lower end beam is attached to the opposed second end portion of the second lower side beam on the second interior side of the second lower side beam and the opposed second end of the fourth lower end beam is attached to the opposed second end portion of the third lower side beam on the interior side of the third lower side beam, the lower side beams being in a parallel relationship and transverse to the lower end beams thereby forming the lower rectangular frame; a plurality of posts, each of the lower side beams having a first post attached thereto and extending upward from its top side at its first end portion and a second post attached thereto and extending upward from its top side at its opposed second end portion, the posts being in a parallel relationship and having the same length, each post having a post top end and a plurality of beam mounting areas along the sides of each post and adjacent to the post top end, each post having at least one interior side; an upper rectangular frame having at least three upper side beams, each upper side beam having a first end and an opposed second end, the upper rectangular frame further having at least four upper end beams, each upper end beam having a first end and an opposed second end; where the first end of a first upper side beam is attached to a first beam mounting area of the first post attached to the first lower side beam and the opposed second end of the first upper side beam is attached to a first beam mounting area of the second post attached to the first lower side beam; where the first end of a second upper side beam is attached to a first beam mounting area of the first post attached to the second lower side beam and the opposed second end of the upper side beam is attached to a first beam mounting area of the second post attached to the second lower side beam; where the first end of a third upper side beam is attached to a first beam mounting area of the first post attached to the second lower side beam and the opposed second end of the upper side beam is attached to a first beam mounting area of the second post attached to the second lower side beam; where the first end of a first upper end beam is attached to a second beam mounting area of the first post attached to the first lower side beam and the opposed second end of the first upper end beam is attached to a second beam mounting area of the first post attached to the second lower side beam; and where the first end of a second upper end beam is attached to a second beam mounting area of the second post attached to the first lower side beam and the opposed second end of the second upper end beam is attached to a second beam mounting area of the second post attached to the second lower side beam thereby forming the upper rectangular frame; where the first end of a third upper end beam is attached to a third beam mounting area of the first post attached to the second lower side beam and the opposed second end of the third upper end beam is attached to a second beam mounting area of the first post attached to the third lower side beam; and where the first end of a fourth upper end beam is attached to a third beam mounting area of the second post attached to the second lower side beam and the opposed second end of the fourth upper end beam is attached to a second beam mounting area of the second post attached to the second lower side beam thereby forming the upper rectangular frame; a plurality of dunnage rails, where a first dunnage rail is attached on an interior side of the first and second posts attached to the first lower side beam and where a second dunnage rail is attached on a first interior side of the first and second posts attached to the second lower side beam, the first and second dunnage rails facing each other; where a third dunnage rail is attached on an interior side of the first and second posts attached to the third lower side beam and where a fourth dunnage rail is attached on a second interior side of the first and second posts attached to the second lower side beam, the third and fourth dunnage rails facing each other; where the first, second, third, and fourth dunnage rails are in a parallel relationship to each other and to the lower side beams and at a same first height thereabove, and; where legs extend downward from the bottom sides of the two lower end beams and from the bottom sides of the two lower side beams underneath their portions where the posts are attached.

Also, the first posts can each have at least one downward sloping groove therein located on the first posts at a location equally above the first height, the grooves in the first posts attached to the first and second lower side beams having a first removable slat therein, the slat extending between these first posts, the grooves in the first posts attached to the second and third lower side beams having a second removable slat therein, the slat extending between these first posts. Additionally, a fifth dunnage rail can be attached on the interior side of the first and second posts attached to the first lower side beam and a sixth dunnage rail can be attached on the first interior side of the first and second posts attached to the second lower side beam, the fifth and sixth dunnage rails facing each other; a seventh dunnage rail can be attached on an interior side of the first and second posts attached to the third lower side beam and an eighth dunnage rail attached on the second interior side of the first and second posts attached to the second lower side beam, the seventh and eighth dunnage rails facing each other; where all the dunnage rails are in a parallel relationship to each other and to the lower side beams; and where the fifth, sixth, seventh, and eighth dunnage rails are at a same second height above their respective lower side beams, the second height being greater than the first height. In this configuration the interior sides of the first and second posts where the first, second, third, fourth, fifth, sixth, seventh, and eighth dunnage rails are to be attached can each have a recessed portion so that the corresponding dunnage rail is recessed therein. Also, the first posts can each have at least one first downward sloping groove therein located on the first posts at a location equally above the first height and below the second height; and where the first posts can each have at least one second downward sloping groove therein located on the first posts at a location above the second height, the grooves between the first and second heights in the first posts attached to the first and second lower side beams have a first removable slat therein, the slat extending between these first posts, the grooves in the first posts attached to the second and third lower side beams having a second removable slat therein, the slat extending between these first posts; the grooves above the second height in the first posts attached to the first and second lower side beams have a third removable slat therein, the slat extending between these first posts, the grooves in the first posts attached to the second and third lower side beams having a fourth removable slat therein, the slat extending between these first posts.

Further, a first contoured piece can be across the top of the first posts and the first and third upper end beams and a second contoured piece can be across the top of the second posts and the second and fourth upper end beams, the contoured pieces each having a recess therein sized to receive a portion of the legs of a second portable barrel rack stacked atop the portable barrel rack.

Even further, an X-brace can be secured between at least one of the areas between two lower side beams and two lower end beams; the open area between the third lower side beam and its upward extending first and second posts and the third upper side beam; or the open areas between second or fourth lower end beam and the second or fourth upper end beam and the second posts therebetween.

Preferably, the attachments of the side beams, end beams, and posts is accomplished by tongue and groove joints and, even more preferably, with the sliding dovetail tongue and groove type joints.

Finally, as with the rack designed to preferably hold 6 barrels, in the rack designed to preferably hold 12 barrels each of the legs is preferably a single piece, a first leg extending below and parallel to the first lower end beam and a second leg extending below and parallel to the second lower end beam.

This summary is provided to introduce a selection of the concepts that are described in further detail in the detailed description and drawings contained herein. This summary is not intended to identify any primary or essential features of the claimed subject matter. Some or all of the described features may be present in the corresponding independent or dependent claims, but should not be construed to be a limitation unless expressly recited in a particular claim. Each embodiment described herein does not necessarily address every object described herein, and each embodiment does not necessarily include each feature described. Other forms, embodiments, objects, advantages, benefits, features, and aspects of the present disclosure will become apparent to one of skill in the art from the detailed description and drawings contained herein. Moreover, the various apparatuses and methods described in this summary section, as well as elsewhere in this application, can be expressed as a large number of different combinations and subcombinations. All such useful, novel, and inventive combinations and subcombinations are contemplated herein, it being recognized that the explicit expression of each of these combinations is unnecessary.

BRIEF DESCRIPTION OF THE DRAWINGS

Some of the figures shown herein may include dimensions or may have been created from scaled drawings. However, such dimensions, or the relative scaling within a figure, are by way of example only, and are not to be construed as limiting the scope of this invention.

DETAILED DESCRIPTION OF THE ILLUSTRATED EMBODIMENTS

Figure 1A:
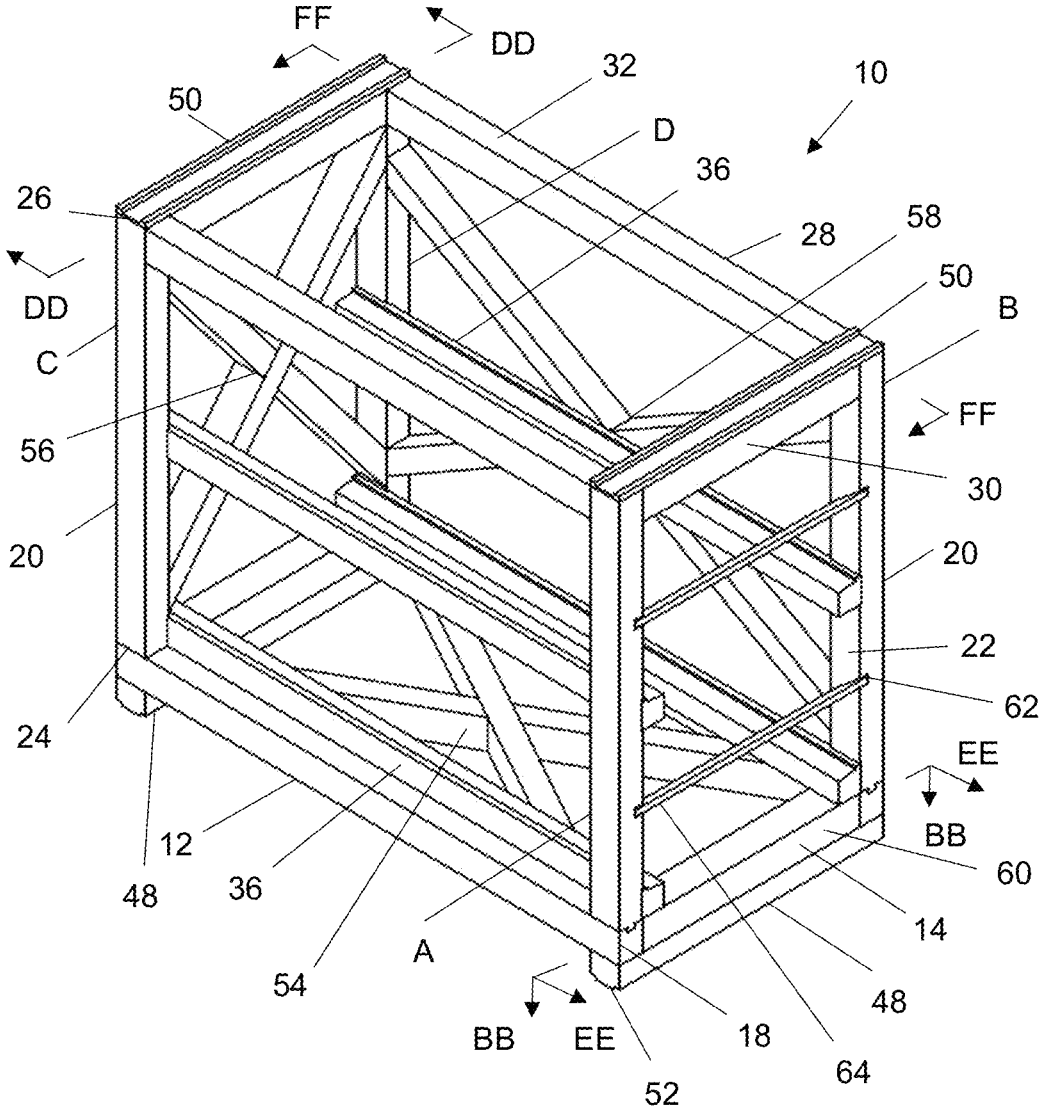
FIG. 1A is a perspective drawing of a first embodiment of a portable barrel rack.

For the purposes of promoting an understanding of the principles of the invention disclosed herein, reference will now be made to one or more embodiments, which may or may not be illustrated in the drawings, and specific language will be used to describe the same. It will nevertheless be understood that no limitation of the scope of the disclosure is thereby intended; any alterations and further modifications of the described or illustrated embodiments, and any further applications of the principles of the disclosure as illustrated herein are contemplated as would normally occur to one skilled in the art to which the disclosure relates. At least one embodiment of the disclosure is shown in great detail, although it will be apparent to those skilled in the relevant art that some features or some combinations of features may not be shown for the sake of clarity.

Any reference to "invention" within this document is a reference to an embodiment of a family of inventions, with no single embodiment including features that are necessarily included in all embodiments, unless otherwise stated. Furthermore, although there may be references to benefits or advantages provided by some embodiments, other embodiments may not include those same benefits or advantages, or may include different benefits or advantages. Any benefits or advantages described herein are not to be construed as limiting to any of the claims.

Specific quantities (spatial dimensions, temperatures, pressures, times, force, resistance, current, voltage, concentrations, wavelengths, frequencies, heat transfer coefficients, dimensionless parameters, etc.) may be used explicitly or implicitly herein; such specific quantities are presented as examples only and are approximate values unless otherwise indicated. Discussions pertaining to specific compositions of matter, if present, are presented as examples only and do not limit the applicability of other compositions of matter, especially other compositions of matter with similar properties, unless otherwise indicated.

Embodiments of the present invention include a portable barrel rack 10. Referring to FIGS. 1A-1F, a first embodiment of a portable barrel rack 10 includes two spaced apart lower side beams 12 extending substantially parallel to each other, and two spaced apart lower end beams 14 extending substantially parallel to each other and extending substantially perpendicular to the lower side beams 12. As most easily seen in FIG. 1B, the ends of the lower end beams 14 abut the lower side beams 12 to form a lower rectangular frame 16 having four corners 18.

Four posts 20, designated A, B, C, and D, each include at least one side 22, a bottom end 24, and a top end 26, and extend substantially vertically upwards from the corners 18 of the lower rectangular frame 16. In some embodiments, the bottom ends 24 engage the lower side beams 12 via a tongue and groove joint, as shown in FIGS. 1A, 1B, and 1D-1F, or other mechanical engagement.

Figure 1B:
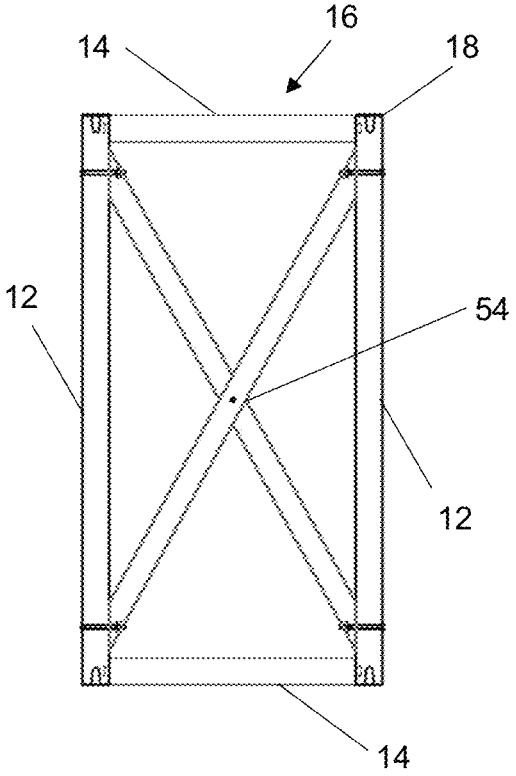
FIG. 1B is a cross-sectional top plan view of the first embodiment along lines BB-BB of FIG. 1A.

As most easily seen in FIG. 1B, two spaced apart upper side beams 28 extend substantially parallel to each other between the top ends 26 of posts A and C and between the top ends 26 of posts B and D. Two upper end beams 30 extend between the top ends 26 of posts A and B and between the top ends 26 of posts C and D. The upper end beams 30 extend substantially parallel to each other and substantially perpendicular to the upper side beams 28, such that the top ends 26 of the posts 20, the upper side beams 28 and upper end beams 30 collectively form an upper rectangular frame 32. In some embodiments, the ends of the upper side beams 28 and the ends of the upper end beams 30 engage the top ends 26 of their respective posts 20 via a tongue and groove joint, as most easily seen in FIG. 1C, or other means of mechanical engagement. As shown in FIG. 1A, the upper rectangular frame 32 is spaced apart from the lower rectangular frame 16 by the posts 20. The spacing between posts A and C is greater than the spacing between posts A and B. Correspondingly, the side beams 12, 28 are longer than the end beams 14, 30. The various beams and posts may be attached by bolts, screws, nails, adhesives, or other means or combination of means as commonly known in the art.

Figure 1C:
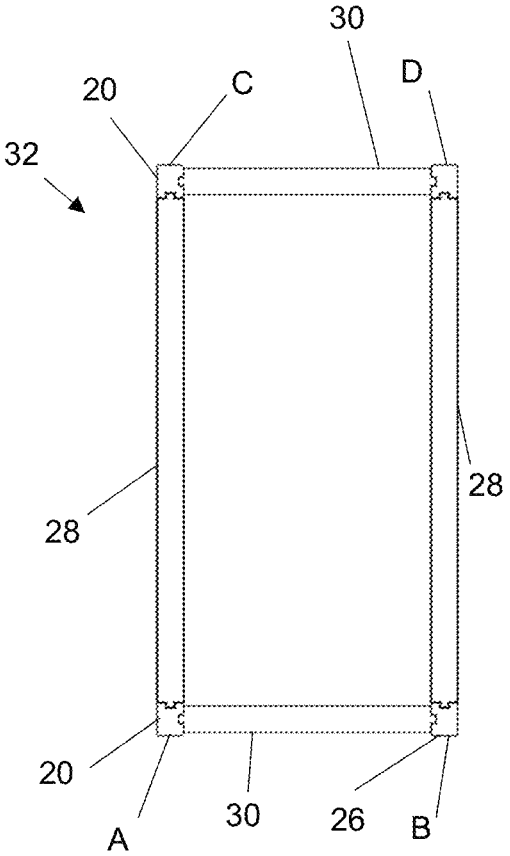
FIG. 1C is a top view of the upper rectangular frame of the first embodiment with the contour omitted for clarity.
Figure 1D:
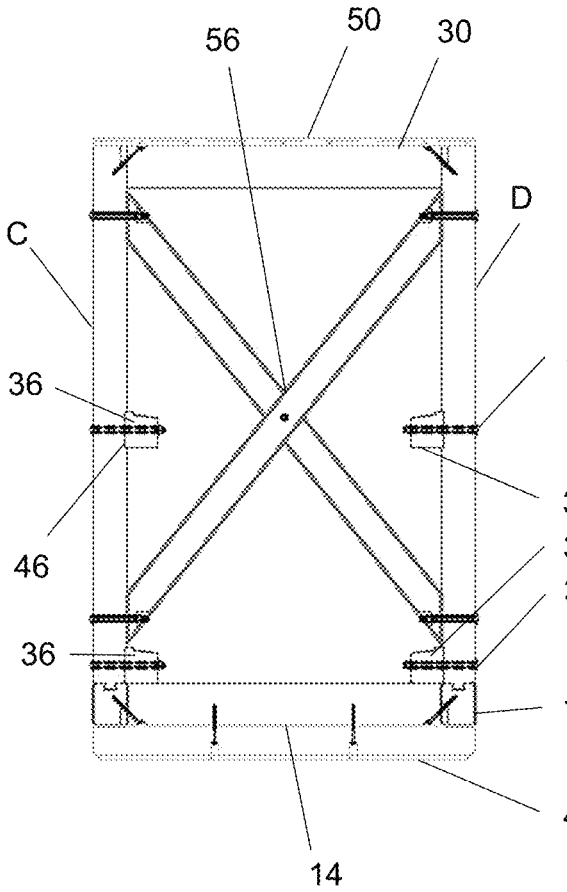
FIG. 1D is a cross-sectional end view of the first embodiment along lines DD-DD of FIG. 1A.
Figure 1E:
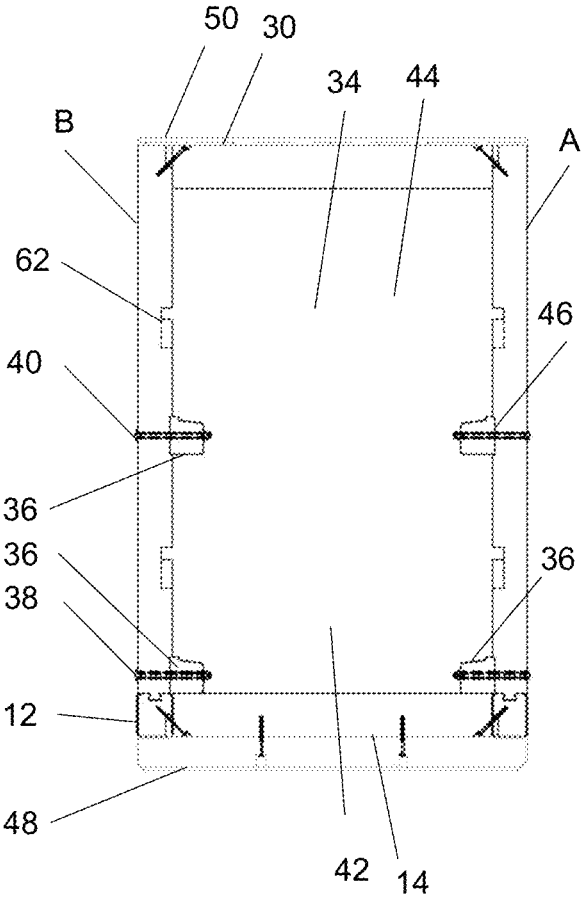
FIG. 1E is a cross-sectional end view of the first embodiment along lines EE-EE of FIG. 1A.

As most readily seen in FIGS. 1A, 1C and 1D, a barrel aisle 34 is defined between posts A and B and between posts C and D. Post A is connected to post C and post B is connected to post D by upper and lower side beams 12, 28 and also by horizontal beams configured to support barrels, generally referred to in the industry as dunnage 36. As shown in FIGS. 1C and 1D, dunnage 36 is affixed to the sides 22 of the posts 20 defining the barrel aisle 34 and is configured to support barrels between posts A and B and between posts C and D. In the depicted embodiment, lengths of dunnage 36 extend between posts A and B and between posts C and D at a first height 38. Additional lengths of dunnage 36 extend between posts A and B and between posts C and D at a second height 40, creating a first row 42 for supporting barrels at the first height 38 and a second row 44 for supporting barrels at the second height 40, above the first row 42. In some embodiments, the dunnage 36 is tapered on its top surface to substantially match the taper of barrels that will be rolled along and supported by the dunnage 36. In certain embodiments (not shown) the dunnage is tapered on both its top and bottom surfaces to substantially match the taper of barrels such that, in the event of damage to the top surface, the dunnage may be removed from the posts, rotated upside down, and reattached to the posts, using the undamaged bottom surface as the top surface in this new orientation.

In some embodiments, holes are pre-drilled in posts at the first height 38 and the second height 40. A ¼" deep recess 46 is formed in each post to receive a portion of the dunnage 36. The dunnage 36 is predrilled to match locations of the spaced apart posts 20. The dunnage 36 is then inserted into the respective recesses 46, aligning the predrilled holes in the dunnage 36 with the pre-drilled holes in the posts 20, and bolts are inserted through the posts 20 and dunnage 36 to fasten them together.

In some embodiments, the portable barrel rack 10 further includes a pair of horizontally extending beams, referred to as legs 48 positioned below the lower rectangular frame 16 and extending parallel to the lower end beams 14. The legs 48 serve to space the lower rectangular frame 16 above the floor, ground, or other supporting surface so that the forks of a forklift may be inserted beneath the lower rectangular frame 16 and the forklift may lift the entire portable barrel rack 10.

In some embodiments, the upper surface of the upper rectangular frame 32 includes contours 50 extending parallel to the upper end beams 30. The contours 50 may be formed into the upper rectangular frame 32 or may be a separate piece attached to the upper rectangular frame 32. The contours 50 are shaped to receive the bottoms 52 of the legs 48. In the depicted embodiment, the bottoms 52 of the legs 48 have a male profile and the contours 50 have a corresponding female profile shaped to receive the bottoms 52 of the legs 48. In use, one portable barrel rack 10 may be stacked atop another portable barrel rack 10, the contours 50 of the lower rack receiving the bottoms 52 of the legs 48 of the upper rack to mechanically engage the racks together and prevent lateral movement of the upper rack.

Figure 1F:
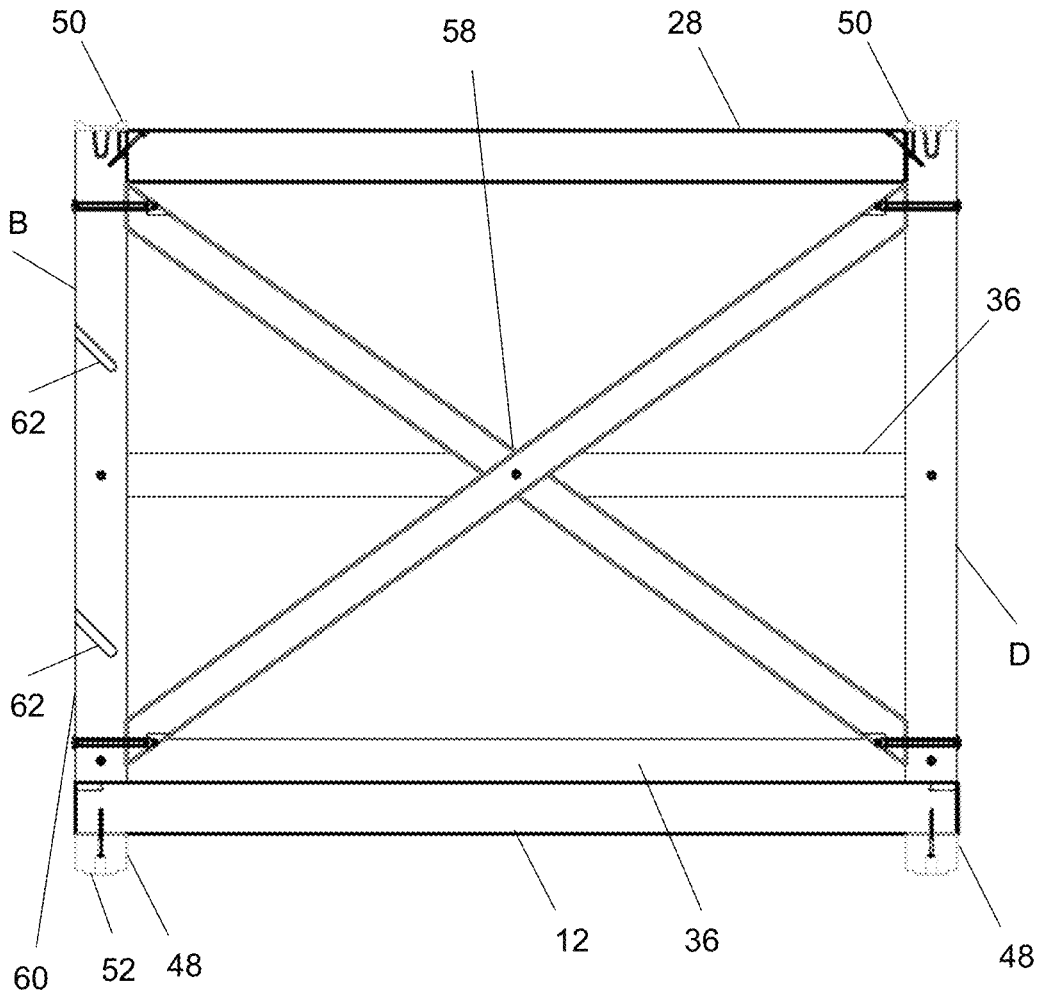
FIG. 1F is a cross-sectional side view of the first embodiment along lines FF-FF of FIG. 1A.

In some embodiments, the portable barrel rack 10 includes one or more X-shaped cross braces to provide additional structural support and stability. As shown in FIGS. 1A and 1B, the depicted first embodiment includes a first cross brace 54 extending between the spaced apart lower side beams 12, providing structural support to the lower rectangular frame 16. As shown in FIGS. 1A and 1D, a second cross brace 56 extends between the spaced posts C and D. As shown in FIGS. 1A and 1F, a third cross brace 58 extends between spaced posts B and D. In this embodiment, each of the first cross brace 54, second cross brace 56, and third cross brace 58 are each aligned on a plane perpendicular to the other two cross braces.

The depicted first embodiment of a portable barrel rack 10 includes a loading end 60, that being the end defined by posts A and B. Barrels arranged on their sides are loaded into each row 42, 44 of the portable barrel rack 10 at the loading end 60, and are supported by the dunnage 36. As shown in FIGS. 1A and 1D, the second cross brace 56 extending between posts C and D prevents barrels from rolling out of the end opposite the loading end 60. In the depicted embodiment, a louver-style system is used to prevent barrels from rolling out of the loading end 60. The sides 22 of posts A and B defining the barrel aisle 34 each include two grooves 62 extending diagonally downward, one vertically aligned with the first row 42 and one vertically aligned with the second row 44. Once barrels are loaded into the portable barrel rack 10, a slat 64 extending between posts A and B is removably inserted into the grooves 62 aligned with the first row 42 and another slat 64 extending between posts A and B is removably inserted into the grooves 62 aligned with the second row 44, preventing barrels in each row from rolling out of the loading end. Preferably, the barrels snugly fit between the slats 64 and the second cross brace 56 to prevent the barrels from rolling along the dunnage 36 during transportation of the rack 10. Optionally, a spacer (not shown) may be inserted between the second cross brace 56 and the barrels to ensure a snug fit. In other embodiments, the grooves 62 and slats 64 may be omitted and other means known in the art, such as ropes, chains, gates, etc., may be used to prevent barrels from rolling out of the loading end 60.

The dimensions of the first embodiment of the portable barrel rack 10 may vary to accommodate different sizes of barrels, different numbers of barrels in each row, and different numbers of rows (i.e., only a first row, a first and second row as depicted, or additional rows). In an embodiment designed to receive two rows of bourbon barrels, each row having three barrels, the rack is 6' 10½" high, 7' 1¾" long, and 3' 9" wide. In this embodiment, the dunnage is 4⅜" wide×5" high×7' 1¾" long, and is attached to the posts at a first height of 11¼" and a second height of 3' 11," as measured from the bottom of the leg. In another embodiment designed to receive two rows of Bordeaux barrels, each row having three barrels, the rack is 7' 3¼" high, 7' 11¾" long, and 3' 11" wide. In this embodiment, the dunnage is 4⅜" wide×5" high×7' 11¾" long, and is attached to the posts at a first height of 11¼" and a second height of 4' 2½," as measured from the bottom of the leg. In another embodiment designed to receive two rows of Burgundy barrels, each row having three barrels, the rack is 7' 3¼" high, 7' 11¾" long, and 3' 11" wide. In this embodiment, the dunnage remains 4⅜" wide×5" high×7' 11¾" long, but a 1" spacer is included between the dunnage and the posts to account for the shorter end-to-end height of a Burgundy barrel. The dunnage is attached to the posts at a first height of 11¼" and a second height of 4' 2½", as measured from the bottom of the leg.

Referring now to FIGS. 2A-2F, a second embodiment of a portable barrel rack 110 includes three spaced apart lower side beams 112 extending substantially parallel to each other, and four spaced apart lower end beams 114 extending substantially parallel to each other and extending substantially perpendicular to the lower side beams 112. As most easily seen in FIG. 2B, the ends of the lower end beams 112 abut the lower side beams 114 to form a lower rectangular frame 116 having four corners 118.

Six posts 120, designated A, B, C, D, E, and F each include at least one side 122, a bottom end 124 and a top end 126, and extend substantially vertically upwards from the corners 118 of the lower rectangular frame 116. In some embodiments, the bottom ends 124 engage the lower side beams 112 via a tongue and groove joint, as shown in FIGS. 2A, 2B, and 2D-2F, or other mechanical engagement.

Figure 2A:
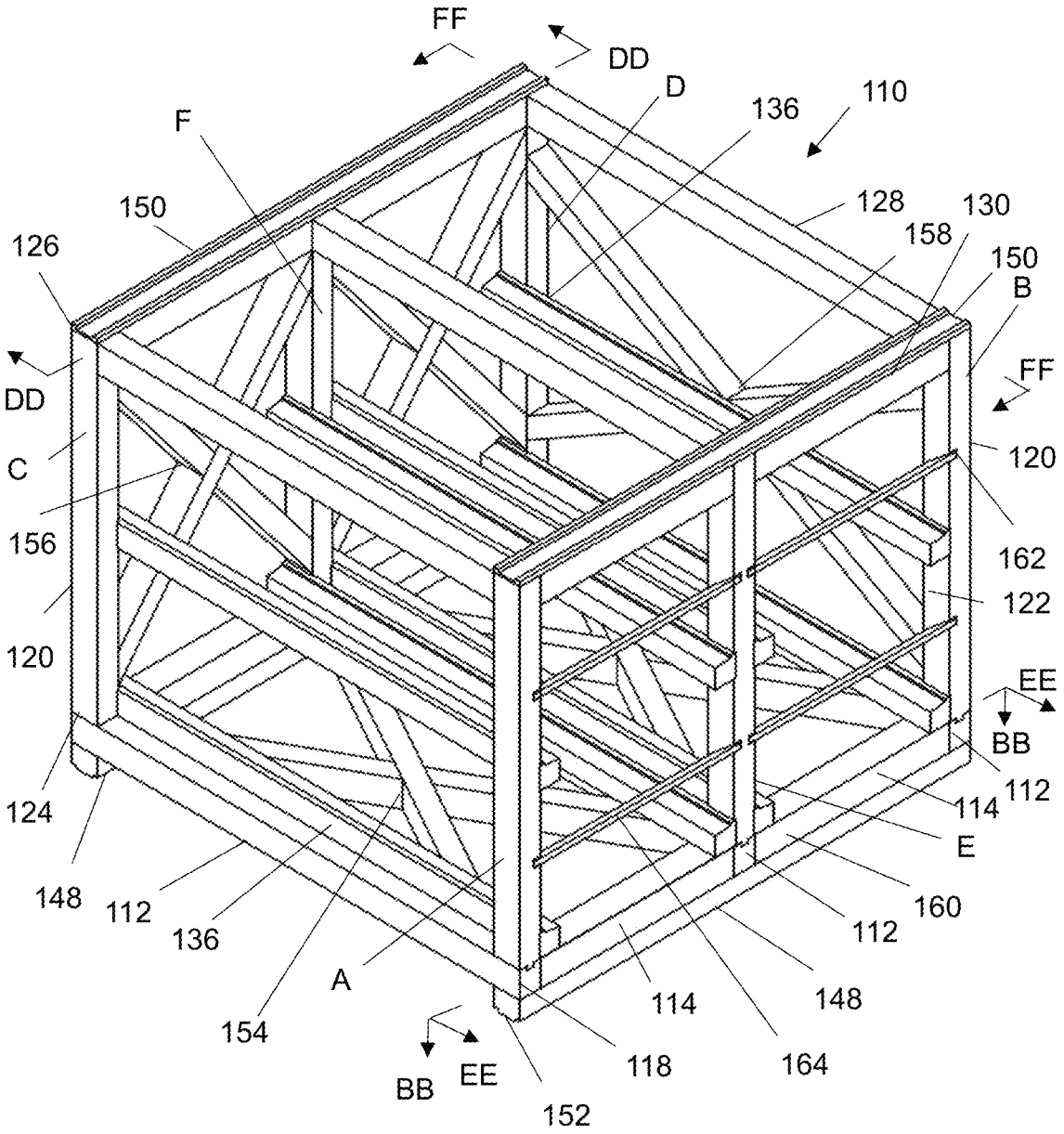
FIG. 2A is a perspective view of a second embodiment of a portable barrel rack.
Figure 2B:
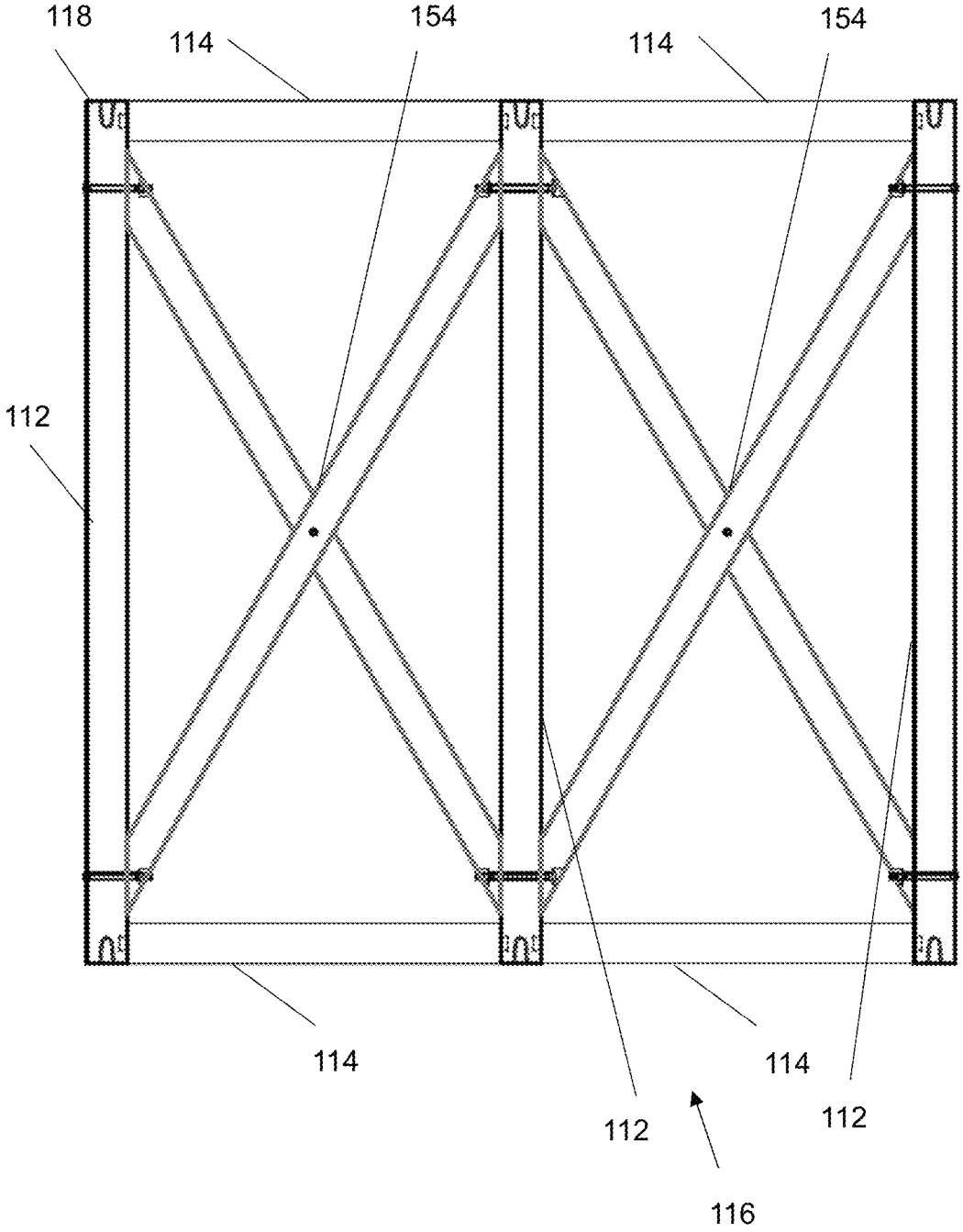
FIG. 2B is a cross-sectional top plan view of the second embodiment along lines BB-BB of FIG. 2A.
Figure 2C:
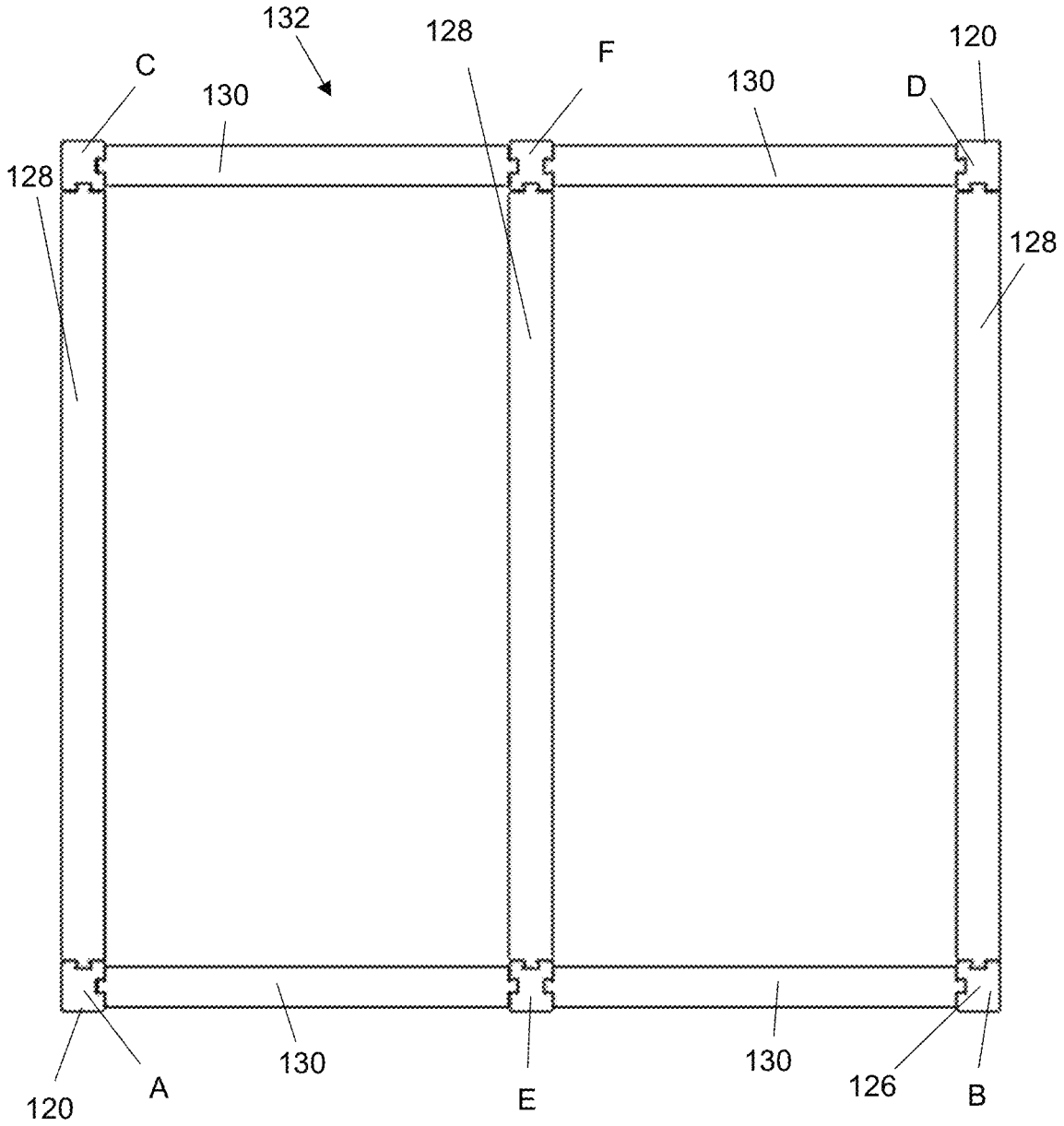
FIG. 2C is a top view of the upper rectangular frame of the second embodiment with the contour omitted for clarity.

As most easily seen in FIG. 2C, three spaced apart upper side beams 128 extend substantially parallel to each other between the top ends 126 of posts A and C, between the top ends 126 of posts E and F, and between the top ends 126 of posts B and D. Four upper end beams 130 extend between the top ends of posts A and E, E and B, C and F, and F and D, respectively. The upper end beams 130 extend substantially parallel to each other and substantially perpendicular to the upper side beams 128, such that the top ends 126 of the posts 120, the upper side beams 128 and upper end beams 130 collectively form an upper rectangular frame 132. In some embodiments, the ends of the upper side beams 128 and the ends of the upper end beams 130 engage the top ends 126 of their respective posts 120 via a tongue and groove joint, as most easily seen in FIG. 2C, or other means of mechanical engagement. As shown in FIG. 2E, the upper rectangular frame 132 is spaced apart from the lower rectangular frame 116 by the posts 120. In the depicted second embodiment, the side beams 112, 128 are longer than the end beams 114, 130. The various beams and posts may be attached by bolts, screws, nails, adhesives, or other means or combination of means as commonly known in the art.

Figure 2D:
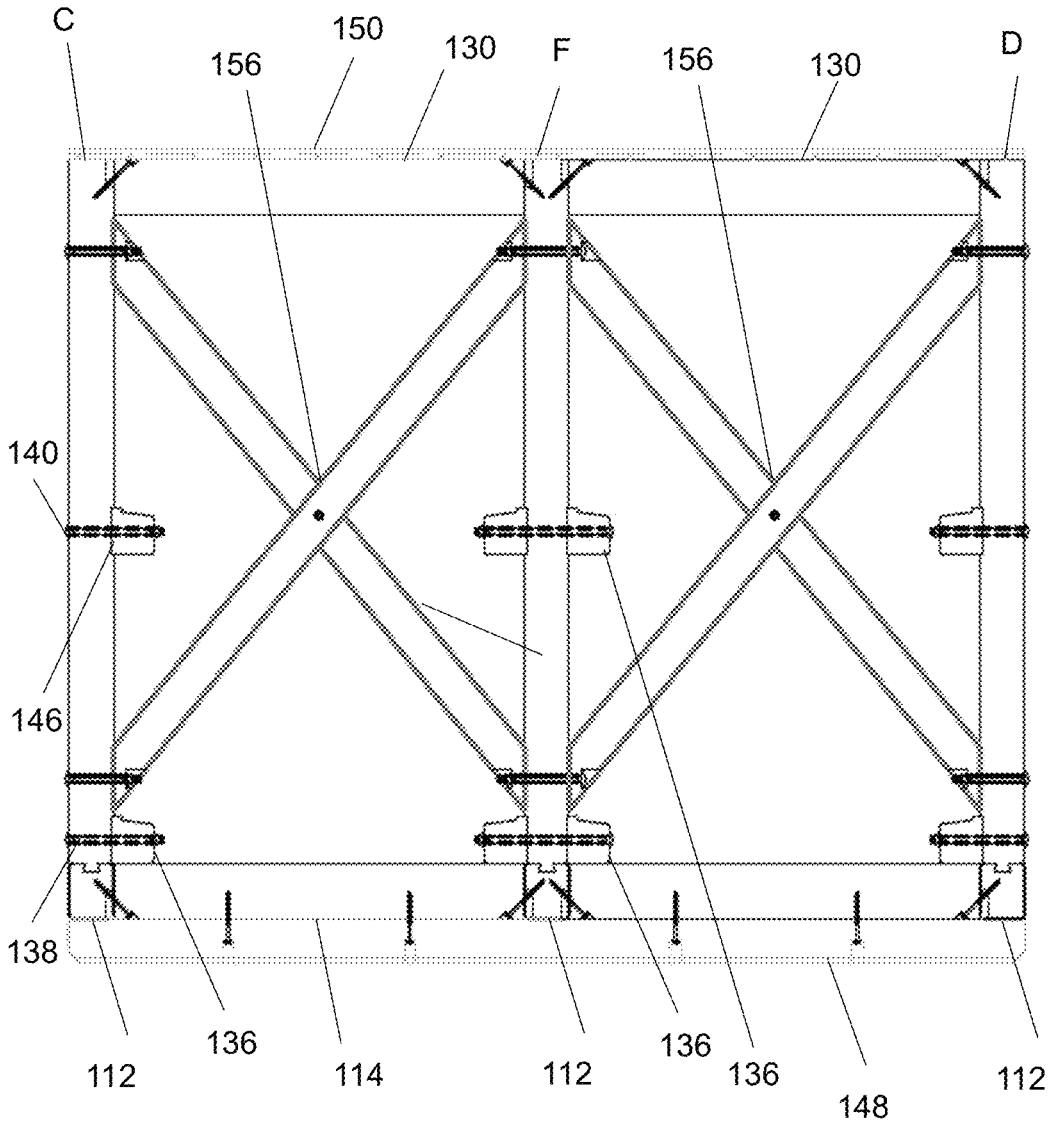
FIG. 2D is a cross-sectional end view of the second embodiment along lines DD-DD of FIG. 2A.
Figure 2E:
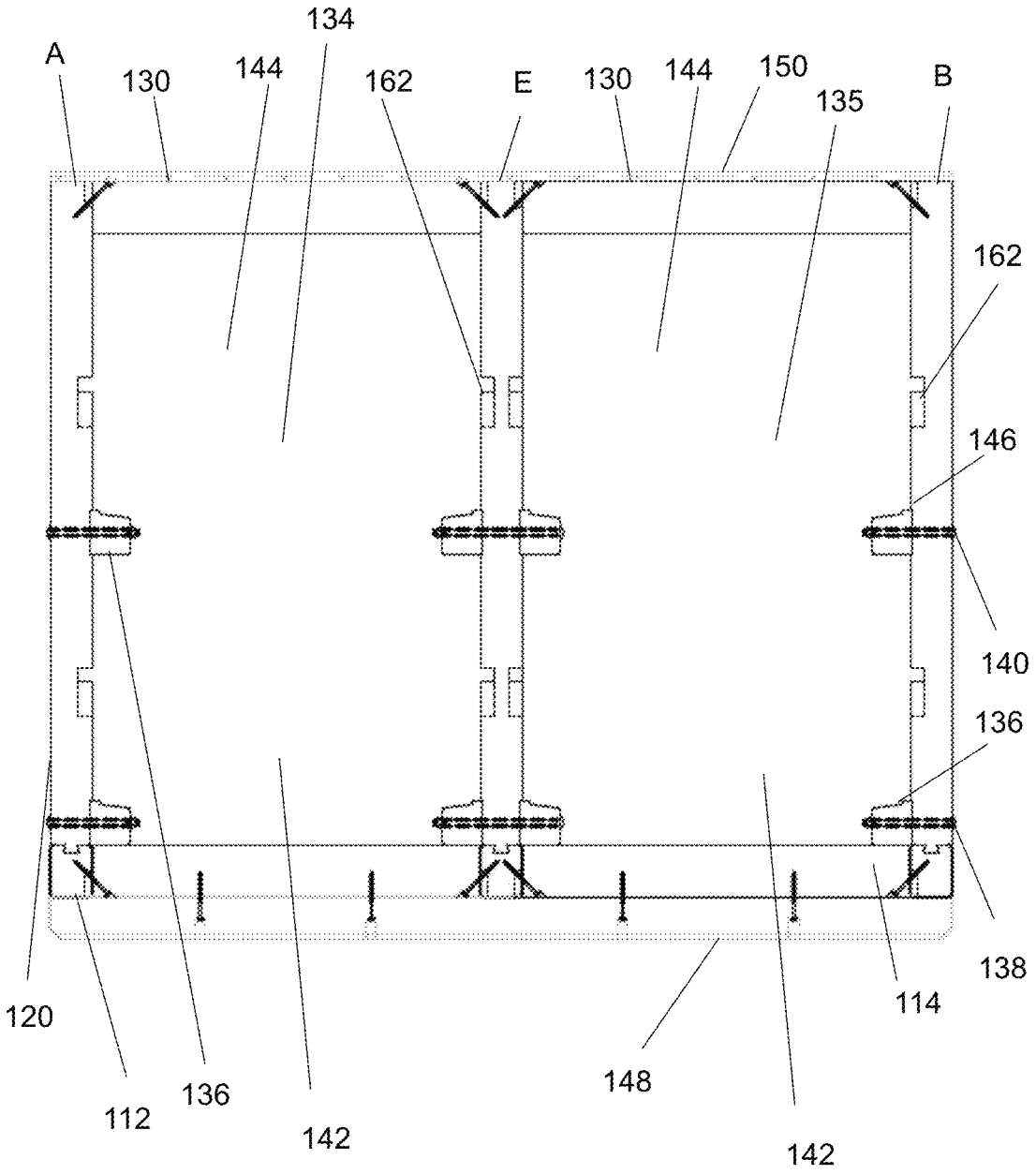
FIG. 2E is a cross-sectional end view of the second embodiment along lines EE-EE of FIG. 2A.
Figure 2F:
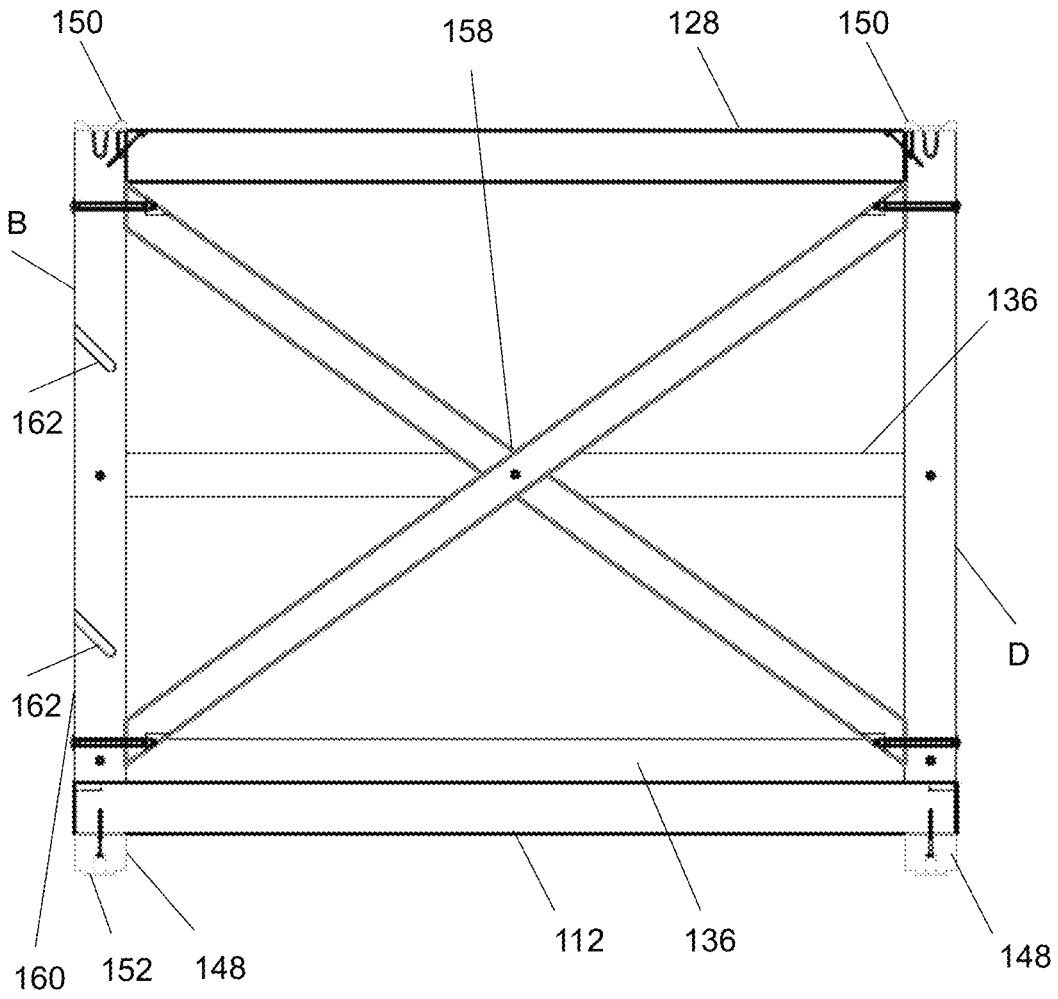
FIG. 2F is a cross-sectional side view of the second embodiment along lines FF-FF of FIG. 2A.

As most readily seen in FIGS. 2D and 2E, a first barrel aisle 134 is defined between posts A and E and between posts C and F. A second barrel aisle 135 is defined between posts E and B and between posts F and D. Post A is connected to post C, post E is connected to post F, and post B is connected to post D by upper and lower side beams 112, 128 and also by dunnage 136. As shown in FIGS. 2D and 2E, dunnage is affixed to the sides 122 of the posts 120 defining the barrel aisles 134, 135 and is configured to support barrels between posts 120. In the depicted embodiment, lengths of dunnage 136 extend between posts A and B, between posts E and F, and between posts C and D at a first height 138. Additional lengths of dunnage 136 extend between posts A and B, between posts E and F, and between posts C and D at a second height 140, allowing for two first rows 142 (one row per barrel aisle) for supporting barrels at the first height 138 and two second rows 144 (one row per barrel aisle) for supporting barrels at the second height 140, above the first rows 142. In some embodiments, the dunnage 136 is tapered on its top surface to substantially match the taper of barrels that will be rolled along and supported by the dunnage 136. In certain embodiments (not shown) the dunnage is tapered on both its top and bottom surfaces to substantially match the taper of barrels such that, in the event of damage to the top surface, the dunnage may be removed from the posts, rotated upside down, and reattached to the posts, using the undamaged bottom surface as the top surface in this new orientation.

In some embodiments, holes are pre-drilled in posts 120 at the first height 138 and the second height 140. A ¼" deep recess 146 is formed in each post to receive a portion of the dunnage 136. The dunnage 136 is predrilled to match locations of the spaced apart posts 120. The dunnage 136 is then inserted into the respective recesses 146, aligning the predrilled holes in the dunnage 136 with the pre-drilled holes in the posts 20, and bolts are inserted through the posts 120 and dunnage 136 to fasten them together.

The depicted second embodiment of a portable barrel rack 110 further includes legs 148 and contours 150 similar to those in the first embodiment of the portable barrel rack 10 to facilitate transportation by forklift and stacking racks 110 atop each other.

Similar to the first embodiment, the second embodiment of the portable barrel rack 110 includes a one or more X-shaped cross braces. As shown in FIGS. 2A and 2B, first cross braces 154 extend between the spaced apart lower side beams 112, providing structural support to the lower rectangular frame. As shown in FIGS. 2A and 2D, second cross braces 156 extend between the spaced posts C and F and between spaced posts D and F. As shown in FIG. 2A, a third cross brace 158 extends between posts B and D, providing additional structural support. In this embodiment, each of the first cross braces 154, second cross braces 156, and third cross brace 158 are each aligned on a plane perpendicular to the other two cross braces.

The depicted second embodiment of a portable barrel rack 110 includes a loading end 160, that being the end defined by posts A, B, and E. Barrels arranged on their sides are loaded into the rows 142, 144 at the loading end 160, and are supported by the dunnage 136. As shown in FIGS. 2A and 2D, the second cross braces 156 extending between posts C and F and between posts F and D prevent barrels from rolling out of the end opposite the loading end 160. In the depicted embodiment, a louver-style system is used to prevent barrels from rolling out of the loading end 160. The sides 122 of posts A and C defining the first barrel aisle 134 and the sides 122 of posts B and C defining the second barrel aisle 135 each include two grooves 162 extending diagonally downward, one vertically aligned with the first row 142 and one vertically aligned with the second row 144. Similar to the first embodiment, once barrels are loaded into the rack, slats 164 are removably inserted into the grooves 162 preventing barrels in each row 142, 144 and aisle 134, 135 from rolling out of the loading end 160. Preferably, the barrels snugly fit between the slats 164 and the second cross braces 156 to prevent the barrels from rolling along the dunnage 136 during transportation of the rack 110. Optionally, a spacer (not shown) may be inserted between the second cross braces 156 and the barrels to ensure a snug fit. In other embodiments, the grooves 162 and slats 164 may be omitted and other means known in the art, such as ropes, chains, gates, etc., may be used to prevent barrels from rolling out of the loading end of the rack.

Reference systems that may be used herein can refer generally to various directions (e.g., top, bottom, leftward, rightward, forward and rearward), which are merely offered to assist the reader in understanding the various embodiments of the disclosure and are not to be interpreted as limiting.

While examples, one or more representative embodiments, and specific forms of the disclosure, have been illustrated and described in detail in the drawings and foregoing description, the same is to be considered as illustrative and not restrictive or limiting. The description of particular features in one embodiment does not imply that those particular features are necessarily limited to that one embodiment. Some or all of the features of one embodiment can be used in combination with some or all of the features of other embodiments as would be understood by one of ordinary skill in the art, whether or not explicitly described as such. One or more exemplary embodiments have been shown and described, and all changes and modifications that come within the spirit of the disclosure are desired to be protected.

The invention claimed is:

1. A portable barrel rack configured to store at least one barrel therein, comprising:

a) a lower rectangular frame having at least two lower side beams, each lower side beam having a top side, a bottom side, at least one interior side, a first end portion and an opposed second end portion, the lower rectangular frame further having at least two lower end beams, each lower end beam having a top side, a bottom side, a first end and an opposed second end;

wherein the first end of a first lower end beam from said at least two lower end beams is attached to the first end portion of a first lower side beam from said at least two lower side beams on an interior side of the first lower side beam and the opposed second end of the first lower end beam is attached to the first end portion of a second lower side beam from said at least two lower side beams on an interior side of the second lower side beam, wherein the first end of a second lower end beam from said at least two lower end beams is attached to the opposed second end portion of the first lower side beam on the interior side of the first lower side beam and the opposed second end of the second lower end beam is attached to the opposed second end portion of the second lower side beam on the interior side of the second lower side beam, the at least two lower side beams being in a parallel relationship and transverse to the at least two lower end beams thereby forming the lower rectangular frame;

b) a plurality of posts, each of the lower side beams having a first post from said plurality of posts is attached to and extends upward from its top side at its first end portion and a second post from said plurality of posts is attached to and extends upward from its top side at its opposed second end portion, the posts being in a parallel relationship and having the same length, each post having a post top end and a plurality of beam mounting areas along sides of each post and adjacent to the post top end, the side of each post having at least one interior side;

c) an upper rectangular frame having at least two upper side beams, each upper side beam having a first end and an opposed second end, the upper rectangular frame further having at least two upper end beams, each upper end beam having a first end and an opposed second end;

wherein the first end of a first upper side beam from said at least two upper side beams is attached to a first beam mounting area of the first post that is attached to the first lower side beam and the opposed second end of the first upper side beam is attached to a first beam mounting area of the second post that is attached to the first lower side beam;

wherein the first end of a second upper side beam from said at least two upper side beams is attached to a first beam mounting area of the first post that is attached to the second lower side beam and the opposed second end of the second upper side beam is attached to a first beam mounting area of the second post that is attached to the second lower side beam;

wherein the first end of a first upper end beam is attached to a second beam mounting area of the first post that is attached to the first lower side beam and the opposed second end of the first upper end beam is attached to a second beam mounting area of the first post that is attached to the second lower side beam; and wherein the first end of a second upper end beam is attached to a second beam mounting area of the second post that is attached to the first lower side beam and the opposed second end of the second upper end beam is attached to a second beam mounting area of the second post that is attached to the second lower side beam thereby forming the upper rectangular frame;

d) a plurality of dunnage rails, wherein a first dunnage rail from said plurality of dunnage rails is attached on an interior side of the first and second posts that are attached to the first lower side beam and wherein a second dunnage rail from said plurality of dunnage rails is attached on an interior side of the first and second posts that are attached to the second lower side beam, wherein the first and second dunnage rails are in a parallel relationship to each other and above the first and second lower side beams and at a same first height thereabove, the first and second dunnage rails face each other;

e) wherein legs extend downward from the bottom sides of the first and second lower end beams and from the bottom sides of the first and second lower side beams underneath their portions where the posts are attached, wherein each first post has a first downward sloping groove therein located on each first post, the first grooves having a removable slat therein, the removable slat extends between the first posts;

wherein each second post is free from any downward sloping grooves therein and the second posts are free of any slats thereon;

wherein, when in use, the removable slat is configured to be removed from the first downward sloping grooves so that the at least one barrel can be inserted within the portable barrel rack between the first posts.

2. The portable barrel rack of claim 1, further having:

a third dunnage rail that is attached on an interior side of the first and second posts that is attached to the first lower side beam and a fourth dunnage rail that is attached on an interior side of the first and second posts that is attached to the second lower side beam, wherein the third and fourth dunnage rails are in a parallel relationship to each other and above the first and second lower side beams and at a same second height thereabove, the second height being greater than the first height, the third and fourth dunnage rails face each other.

3. The portable barrel rack of claim 2, where each first post has a second downward sloping groove therein located on each first post, the second grooves each having a removable slat therein, the slats extend between the first posts.

4. The portable barrel rack of claim 1, further having a first contoured piece across the top of each first post and the first upper end beam and a second contoured piece across the top of each second post and the second upper end beam, each contoured piece having a recess therein sized to receive a portion of the legs of a second portable barrel rack stacked atop the portable barrel rack.

5. The portable barrel rack of claim 2, wherein the interior sides of the first and second posts where the first, second, third, and fourth dunnage rails are to be attached each have a recessed portion so that the corresponding dunnage rail is recessed therein.

6. The portable barrel rack of claim 1, wherein an X-brace is secured between at least one area between the lower side beams and the lower end beams; the open area between the second lower side beam and its upward extending first and second posts and the second upper side beam; the open area between the first lower side beam and its upward extending first and second posts and the first upper side beam; or the open area between the second lower end beam and the second upper end beam and the second posts therebetween.

7. The portable barrel rack of claim 1, wherein the attachments of the side beams, end beams, and posts is accomplished by tongue and groove attachments.

8. The portable barrel rack of claim 1, wherein each of the legs is a single piece, a first leg extends below and parallel to the first lower end beam and a second leg extends below and parallel to the second lower end beam.

9. A portable barrel rack configured to store at least one barrel therein, comprising:

a) a lower rectangular frame having at least three lower side beams, each lower side beam having a top side, a bottom side, at least one interior side, a first end portion and an opposed second end portion, the lower rectangular frame further having at least four lower end beams, each lower end beam having a top side, a bottom side, a first end and an opposed second end;

wherein the first end of a first lower end beam from said at least four lower end beams is attached to the first end portion of a first lower side beam from said at least three lower side beams on an interior side of the first lower side beam and the opposed second end of the first lower end beam is attached to the first end portion of a second lower side beam from said at least three lower side beams on a first interior side of the second lower side beam, wherein the first end of a second lower end beam from said at least four lower end beams is attached to the opposed second end portion of the first lower side beam on the interior side of the first lower side beam and the opposed second end of the second lower end beam is attached to the opposed second end portion of the second lower side beam on the first interior side of the second lower side beam, wherein the first end of a third lower end beam from said at least four lower end beams is attached to the first end portion of the second lower side beam on a second interior side of the second lower side beam and the opposed second end of the third lower end beam is attached to the first end portion of a third lower side beam from said at least three lower side beams on a first interior side of the third lower side beam, wherein the first end of a fourth lower end beam from said at least four lower end beams is attached to the opposed second end portion of the second lower side beam on the second interior side of the second lower side beam and the opposed second end of the fourth lower end beam is attached to the opposed second end portion of the third lower side beam on the interior side of the third lower side beam, the at least three lower side beams being in a parallel relationship and transverse to the lower end beams thereby forming the lower rectangular frame;

b) a plurality of posts, each of the lower side beams having a first post from said plurality of posts is attached thereto and extends upward from its top side at its first end portion and a second post from said plurality of posts is attached thereto and extends upward from its top side at its opposed second end portion, the posts being in a parallel relationship and having the same length, each post having a post top end and a plurality of beam mounting areas along the sides of each post and adjacent to the post top end, the side of each post having at least one interior side;

c) an upper rectangular frame having at least three upper side beams, each upper side beam having a first end and an opposed second end, the upper rectangular frame further having at least four upper end beams, each upper end beam having a first end and an opposed second end;

wherein the first end of a first upper side beam from said at least three upper side beams is attached to a first beam mounting area of the first post that is attached to the first lower side beam and the opposed second end of the first upper side beam is attached to a first beam mounting area of the second post that is attached to the first lower side beam;

wherein the first end of a second upper side beam from said at least three upper side beams is attached to a first beam mounting area of the first post that is attached to the second lower side beam and the opposed second end of the upper side beam is attached to a first beam mounting area of the second post that is attached to the second lower side beam;

wherein the first end of a third upper side beam from said at least three upper side beams is attached to a first beam mounting area of the first post that is attached to the second lower side beam and the opposed second end of the upper side beam is attached to a first beam mounting area of the second post that is attached to the second lower side beam;

wherein the first end of a first upper end beam from said at least four upper end beams is attached to a second beam mounting area of the first post that is attached to the first lower side beam and the opposed second end of the first upper end beam is attached to a second beam mounting area of the first post that is attached to the second lower side beam; and wherein the first end of a second upper end beam from said at least four upper end beams is attached to a second beam mounting area of the second post that is attached to the first lower side beam and the opposed second end of the second upper end beam is attached to a second beam mounting area of the second post that is attached to the second lower side beam thereby forming the upper rectangular frame;

wherein the first end of a third upper end beam from said at least four upper end beams is attached to a third beam mounting area of the first post that is attached to the second lower side beam and the opposed second end of the third upper end beam is attached to a second beam mounting area of the first post that is attached to the third lower side beam; and wherein the first end of a fourth upper end beam from said at least four upper end beams is attached to a third beam mounting area of the second post that is attached to the second lower side beam and the opposed second end of the fourth upper end beam is attached to a second beam mounting area of the second post that is attached to the second lower side beam thereby forming the upper rectangular frame;

d) a plurality of dunnage rails, wherein a first dunnage rail from said plurality of dunnage rails is attached on an interior side of the first and second posts that are attached to the first lower side beam and wherein a second dunnage rail from said plurality of dunnage rails is attached on a first interior side of the first and second posts that are attached to the second lower side beam, the first and second dunnage rails facing each other;

wherein a third dunnage rail from said plurality of dunnage rails is attached on an interior side of the first and second posts that are attached to the third lower side beam and wherein a fourth dunnage rail from said plurality of dunnage rails is attached on a second interior side of the first and second posts that are attached to the second lower side beam, the third and fourth dunnage rails facing each other;

wherein the first, second, third, and fourth dunnage rails are in a parallel relationship to each other and above the first, second, third, and second lower side beams, respectively, and at a same first height thereabove;

e) wherein legs extend downward from the bottom sides of the first, second, third, and fourth lower end beams and from the bottom sides of the first, second, and third lower side beams underneath their portions where the posts are attached;

wherein each first post has at least one first downward sloping groove therein located on each first post, the grooves in the first posts attached to the first and second lower side beams having a first removable slat therein, the slat extending between these first posts, the grooves in the first posts attached to the second and third lower side beams having a second removable slat therein, the slat extending between these first posts;

wherein each second post is free from any downward sloping grooves therein and the second posts are free of any slats thereon;

wherein, when in use, the first and second slats are configured to be removed from the downward sloping grooves so that the at least one barrel can be inserted within the portable barrel rack.

10. The portable barrel rack of claim 9, further having:

a fifth dunnage rail from said plurality of dunnage rails that is attached on the interior side of the first and second posts that is attached to the first lower side beam and a sixth dunnage rail from said plurality of dunnage rails that is attached on the first interior side of the first and second posts that is attached to the second lower side beam, the fifth and sixth dunnage rails facing each other;

a seventh dunnage rail from said plurality of dunnage rails that is attached on an interior side of the first and second posts that is attached to the third lower side beam and an eighth dunnage rail from said plurality of dunnage rails that is attached on the second interior side of the first and second posts that is attached to the second lower side beam, the seventh and eighth dunnage rails facing each other;

wherein the first, second, third, fourth, fifth, sixth, seventh, and eighth dunnage rails are in a parallel relationship to each other and to the first, second, and third lower side beams; and where the fifth, sixth, seventh, and eighth dunnage rails are at a second height above their respective first, second, third, and fourth dunnage rails.

11. The portable barrel rack of claim 10, where each first post has at least one second downward sloping groove therein located on each first post, the second grooves in the first posts attached to the first and second lower side beams have a third removable slat therein, the slat extending between these first posts, the second grooves in the first posts attached to the second and third lower side beams having a fourth removable slat therein, the slat extending between these first posts.

12. The portable barrel rack of claim 9, further having a first contoured piece across the top of each first post and the first and third upper end beams and a second contoured piece across the top of each second post and the second and fourth upper end beams, each contoured piece having a recess therein sized to receive a portion of the legs of a second portable barrel rack stacked atop the portable barrel rack.

13. The portable barrel rack of claim 10, where the interior sides of the first and second posts where the first, second, third, fourth, fifth, sixth, seventh, and eighth dunnage rails are to be attached each have a recessed portion so that the corresponding dunnage rail is recessed therein.

14. The portable barrel rack of claim 9, wherein an X-brace is secured between at least one of the areas between two lower side beams and two lower end beams; the open area between the third lower side beam and its upward extending first and second posts and the third upper side beam; or the open areas between second or fourth lower end beams and the second or fourth upper end beams and the second posts therebetween.

15. The portable barrel rack of claim 9, wherein the attachments of the side beams, end beams, and posts is accomplished by tongue and groove attachments.

16. The portable barrel rack of claim 9, wherein each of the legs is a single piece, a first leg extending below and parallel to the first lower end beam and a second leg extending below and parallel to the second lower end beam.

* * * * *